United States Patent [19]

Assal et al.

[11] 4,218,664

[45] Aug. 19, 1980

[54] TEMPERATURE-COMPENSATED MICROWAVE INTEGRATED CIRCUIT DELAY LINE

[75] Inventors: Tsvi F. Assal, Bethesda; Arnold Berman, Kensington, both of Md.; Christoph E. Mahle, Washington, D.C.

[73] Assignee: Communications Satellite Corporation, Washington, D.C.

[21] Appl. No.: 935,419

[22] Filed: Aug. 22, 1978

[51] Int. Cl.[2] ..... H01P 9/00; H01P 1/30; H01P 3/08

[52] U.S. Cl. ..... 333/156; 333/161; 333/203; 333/204; 333/246

[58] Field of Search ..... 333/203, 204, 205, 17 R, 333/155, 219–221, 234, 246–247, 238, 243, 156–159; 174/68.5; 361/397–402

[56] References Cited

U.S. PATENT DOCUMENTS

| | | | |
|---|---|---|---|
| 3,534,301 | 10/1970 | Golembeski | 333/204 |
| 3,873,949 | 3/1975 | Dorsi et al. | 333/234 |
| 3,916,348 | 10/1975 | Toda et al. | 333/155 |

*Primary Examiner*—Marvin L. Nussbaum

*Attorney, Agent, or Firm*—Sughrue, Rothwell, Mion, Zinn and Macpeak

[57] ABSTRACT

A temperature-compensated microwave integrated circuit device such as a delay line in which the phase delay imparted to signals coupled through the delay line is substantially constant over a wide range of temperatures. A dielectric substrate is provided, with strip conductors on one surface defining a desired device configuration such as a multi-pole Butterworth filter configuration. The substrate is enclosed within a support frame with the lower side of the substrate positioned upon the bottom surface of the enclosure forming a ground plane. A conductive plate is attached to the top cover of the enclosure through a layer of compensating material. As the temperature changes, the layer of compensating material expands or contracts, thereby varying the height of the conductive plate above the substrate, which changes the electromagnetic field pattern of signals propagating along the delay line and, consequently, the propagation velocity. The thickness and coefficient of expansion of the compensating layer are chosen to maintain the delay time through the device at a substantially constant value.

17 Claims, 3 Drawing Figures

TEMPERATURE-COMPENSATED MICROWAVE INTEGRATED CIRCUIT DELAY LINE

BACKGROUND OF THE INVENTION

1. Field of the Invention

The invention relates to microwave integrated circuit devices such as filters and delay lines. More particularly, the invention relates to such devices in which temperature compensation is provided.

2. Description of the Prior Art

In the design of on-board satellite repeater stations, differential QPSK (quaternary phase shift keyed) demodulation is frequently used as it provides the best compromise between carrier-to-noise performance requirements and on-board demodulator circuit complexity as carrier recovery is not needed. The successful implementation of direct modulation of differential QPSK signals requires the provision of a delay line which has very stable phase delay characteristics with expected temperature variations. Typically, a delay of 15–40 nanoseconds is required with an RF phase stability of no more than ±5° for acceptable operation at frequencies on the order of 14 GHz.

The provision of an appropriate length of RF cable was the simplest prior art method of providing a required delay. However, in a communication satellite environment, the expected temperature change would cause the phase delay through a sufficiently long length of RF cable to vary by far more than would be acceptable for use in a differential QPSK demodulator without the use of a temperature-controlled oven. Moreover, the size and weight of the cable would ordinarily be excessive for use in such applications.

It has been known in the prior art to construct a filter device by locating stripline conductors upon a dielectric substrate with a ground plane underlying the dielectric substrate on the opposite side from the stripline conductors. A number of filter sections can be combined upon a single substrate to form a delay line filter using techniques well known in the prior art. Unfortunately, prior art microwave delay line devices exhibited very high temperature dependence upon the delay time of signals propagating through the delay line because of thermal expansion of the dielectric substrate and metal stripline conductors. Even using fused silica or quartz, one of the most temperature-insensitive RF substrate materials available, for an exemplary 10-pole Butterworth filter operating at 14 GHz, a phase shift in the output signal of 17°–32° for a 30° C. temperature increment would be expected. Clearly, this variation is far too high for a differential QPSK demodulator in a communications satellite application.

A number of temperature compensation techniques have been known for compensating for various temperature-dependent properties in microwave integrated circuit devices. In one such one of these schemes as shown in U.S. Pat. No. 3,617,955 to Masland, a substrate material was used which has a negative dielectric temperature coefficient but a positive temperature coefficient of thermal expansion. The frequency shifts in one direction caused by thermal expansion were offset by the change of dielectric constant. This technique is not applicable at all frequencies because the magnitude and sign of the temperature coefficient of the dielectric constant is a function of frequency. Moreover, this technique will not provide the phase degree of stability required for use in a differential QPSK demodulator in a satellite repeater station over the expected range of temperature.

In other prior art temperature compensation schemes, stripline conductors were sandwiched between a dielectric layer and a contiguous overlying compensating layer. An example used in a resonator configuration is seen in U.S. Pat. No. 3,840,828 to Linn et al. Changes in filter parameters caused by thermal expansion and changes in the dielectric constant of the substrate were compensated for by changes in the physical properties of the overlying compensating layer. As in the previously-described technique, this arrangement was limited to lower frequencies and only to a relatively limited temperature range. None of the prior art techniques known were capable of being used in a filter application in which it was required that no dielectric material lie contiguous to the microstrip conductors in which there must be an open space between the surface of the substrate upon which the stripline conductors are located and an adjacent ground plane such as is required in microwave frequency applications.

SUMMARY OF THE INVENTION

Accordingly, it is an object of the present invention to provide a delay line device capable of operating at microwave frequencies and which has an exceedingly small temperature coefficient of delay over a relatively wide range of temperature.

Moreover, it is an object of the present invention to provide such a microwave delay line which is capable of performing adequately in a differential QPSK demodulator application such as would be used in a satellite communications repeater station.

Still further, it is an object of the present invention to provide such a delay line device which is both economical to construct and which may be manufactured using standard manufacturing techniques.

These, as well as other objects of the invention, may be met by providing a microwave integrated circuit delay line device including a substrate of dielectric material upon which a plurality of conductive strips are disposed in such a manner as to form a delay line between input and output conductive strips and further including means for maintaining the delay time for signals propagating through the delay line at a substantially constant value over a predetermined range of temperature for at least a preferred or predetermined frequency. The delay time maintaining means operates by varying the electromagnetic field distribution or pattern adjacent the substrate and conductive strips in accordance with the ambient temperature. Preferably, the electromagnetic field pattern varying means comprises one or more conductors disposed adjacent to the substrate and means for varying the position of the conductors relative to the substrate in accordance with ambient temperature.

Objects of the invention may also be met by providing a temperature-compensated microwave integrated circuit device which includes a substrate of dielectric material upon which are disposed a plurality of conductive strips. A conductive plate is disposed adjacent the substrate, and means provided for varying the position of the conductive plate with respect to the substrate in accordance with changes in temperature to maintain selected parameters such as delay time or a signal phase for a predetermined range of temperature. Again, the conductive strips are preferably disposed in such a pattern as to produce a delay line.

Still further, objects of the invention may be met by a temperature-compensated microwave integrated circuit device which includes a substrate of dielectric material with a plurality of conductive strip including an input conductor and output conductor disposed upon a surface of the substrate and a first conductive plate disposed adjacent the substrate. Means is provided for varying the position of the first conductive plate with respect to the substrate in accordance with changes in temperature, the movement of the first conductive plate being such that the phase of signals at the output conductor is independent of temperature over a predetermined range of temperatures for signals of a preferred frequency. The substrate is supported with a body of compensating material coupling the first conductive plate to the mechanical supporting means. The body of compensating material has dimensions and a coefficient of expansion such that the phase of signals at the output conductor is substantially independent of temperature over at least a predetermined temperature range for signals of a preferred frequency. The mechanical supporting means may include a second conductive plate disposed parallel to the substrate on the side of the substrate opposite the first conductive plate. One or more conductive walls coupled to the second conductive plate are attached to the body of compensating material for providing mechanical support. As thus constructed, the first and second conductive plates and the conductive walls form a closed cavity for signals of the predetermined frequency.

More particularly, the invention may be practiced by a temperature-compensated microwave integrated circuit device which includes a substrate of dielectric material with a plurality of conductive strips disposed thereupon, including an input conductor, an output conductor, a first conductive plate disposed adjacent the substrate with a gap between the substrate and the first conductive plate, a conductive support frame including a second conductive plate and four conductive walls coupled thereto with the substrate disposed within the frame between and parallel to the first and second conductive plates, a cover connected to the conductive walls closing the frame, and a layer of temperature compensating material between the first conductive plate and the cover, wherein the thickness and the coefficient of expansion of the compensating layer are such that the phase of signals at the output conductor is substantially independent of temperature for signals of a preferred frequency. In a preferred embodiment, the temperature compensating layer is formed of a silicon resin. Fused silica is the preferred material for the dielectric substrate. The first and second conductive plates may be rectangular in shape.

DESCRIPTION OF THE PREFERRED EMBODIMENTS

Figure 1:
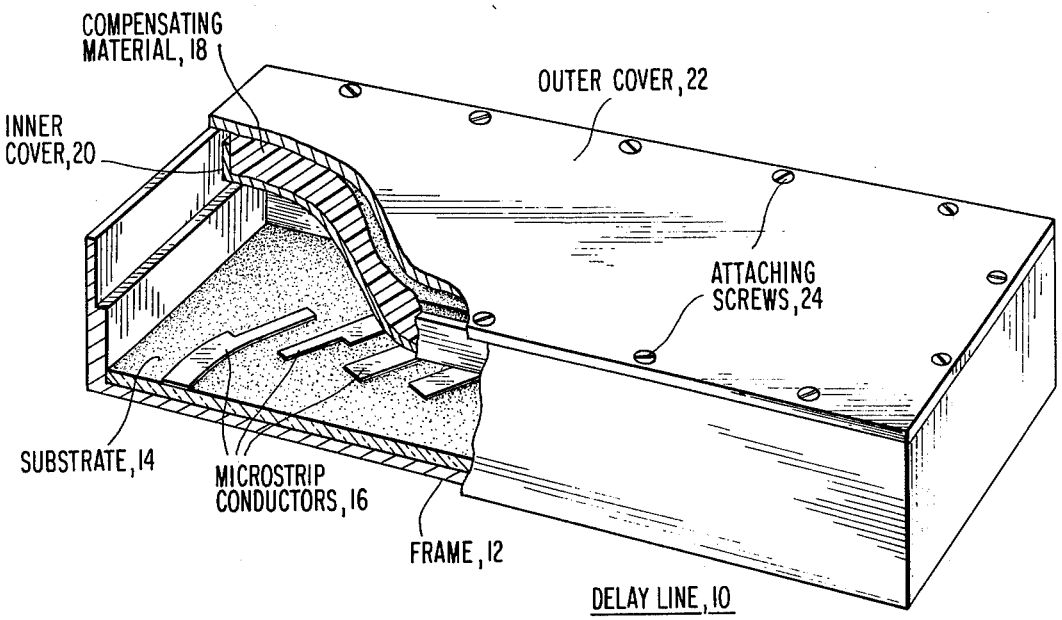
FIG. 1 shows a partially cutaway perspective view of a microwave integrated circuit delay line device constructed in accordance with the teachings of the present invention.
Figure 2:
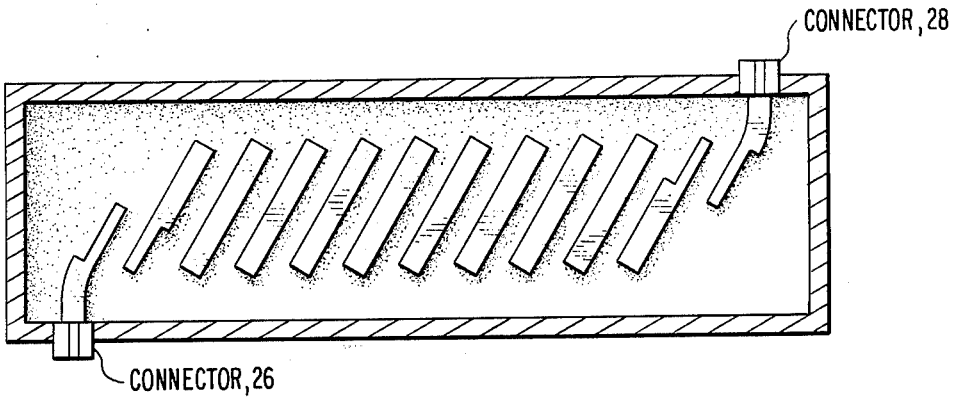
FIG. 2 is a cross-sectional planar view of the device shown in FIG. 1.

Referring first simultaneously to FIGS. 1 and 2, the construction and operation of a microwave integrated circuit delay line device having extremely small temperature coefficient of delay will be described. Substrate 14 is provided as a slab of a dielectric material such as silica or fused quartz. Upon substrate 14 are disposed a number of microstrip conductors 16. The number, shape and pattern of microstrip conductors 16 are chosen in accordance with the function that the device is to perform. In the preferred embodiment, microstrip conductors 16 are patterned so as to provide a 10-pole Butterworth filter as shown in the drawing. The determination of the number, width and length of the various conductors to produce such a filter is well known and will not be repeated here. For example, see the article "Parameters of Microstrip Transmission Lines and of Coupled Pairs of Microstrip Lines," T. G. Bryant and J. A. Weiss, IEEE Trans. MTT., Volume MTT-19, 1971. However, other conductor configurations may be used as well with the invention, depending upon the precise application. For example, it is possible with the invention to produce a microwave device which performs a frequency filtering function with a very temperature stable frequency response characteristic.

Substrate 14 is positioned on the bottom conductive wall or plate of conductive frame 12. To minimize the thermal coefficient of delay, frame 12 should be constructed of a conductive material which has a low thermal coefficient of expansion. Invar is a preferred material. Besides the lower conductive plate, frame 12 includes conductive walls on all four sides of the bottom conductive plate such that substrate 14 is enclosed by frame 12 on all sides except that upon which are disposed microstrip conductors 16. Frame 12 is closed at the top by outer cover 22 secured to frame 12 by attaching screws 24. Outer cover 22 is formed of the same material as frame 12.

A layer of compensating material 18 is attached to the lower surface of outer cover 22. Inner cover 20, formed of a conductive material, preferably the same material as frame 12, is secured to the lower surface of layer of compensating material 18. A slight clearance is provided between the edges of inner cover 20 and the walls of frame 12 so that inner cover 20 may move up and down as the layer of compensating material 18 expands and contracts as the ambient temperature changes. However, the gap between inner cover 20 and the walls of frame 12 should be sufficiently small as to be "beyond cutoff" for signals of the frequencies of interest.

The operation of delay line 10 may be explained heuristically as follows. If there were no layer of compensating material 18 and if inner cover 20 were affixed to frame 12, as the ambient temperature increased, the effective even-mode and, to a somewhat lesser degree, the odd-mode, dielectric coefficient and the physical dimensions of the substrate, printed circuits, and frame would increase accordingly. As a result, both the coupling between the edge-coupled microstrip lines and their effective electrical length would increase, thereby causing an increased delay time as well as a slight change in attenuation. However, as is done with the invention, if the distance between the upper surface of substrate 14 and inner cover 20 were to decrease by an appropriate amount, as the temperature increases, a large portion of the electric field lines which, before the temperature increase, ran from microstrip conductors 16 to the ground plane formed by the lower plate of frame 12 would then extend from microstrip conductors 16 to inner cover 20, which also provides an RF ground return. Therefore, since the dielectric constant of air or vacuum is lower than that of the substrate, the effective even-mode dielectric constant would decrease, thereby resulting in a decrease in delay time. With an appropriate choice of compensating material 18 (which must have a positive bulk coefficient of expansion) and thickness, the decrease in delay time caused by the movement of inner cover 20 towards substrate 14 may be made to just cancel the increase in delay time caused by thermal expansion of the substrate and other components, resulting in a zero first-order temperature coefficient of delay for signals of a predetermined or preferred frequency.

The thickness of layer of compensating material 18 and the type of material used in regard to its bulk coefficient of expansion may be determined by the following procedure. First, inner cover 20 or a substitute therefor is secured to frame 12 at a height above substrate 14 which produces a preferred delay at a chosen temperature. With inner cover 20 thus secured, the temperature is increased and the delay time through delay line 10 measured and recorded for various temperatures. Next, with the temperature returned to the original temperature and held constant at that value, inner cover 20 is moved downward and the change in delay time recorded as a function of the gap height between substrate 14 and inner cover 20. An approximate thickness is then chosen for layer of compensating material 18, and a material having a bulk coefficient of expansion which will produce approximately the desired amount of movement for layer of compensating material 18 to cancel the increase in delay time caused by expansion of the other members of delay line 10 is chosen. The precise thickness of layer of compensating material 18 is then determined so as to produce precise cancellation.

Figure 3:
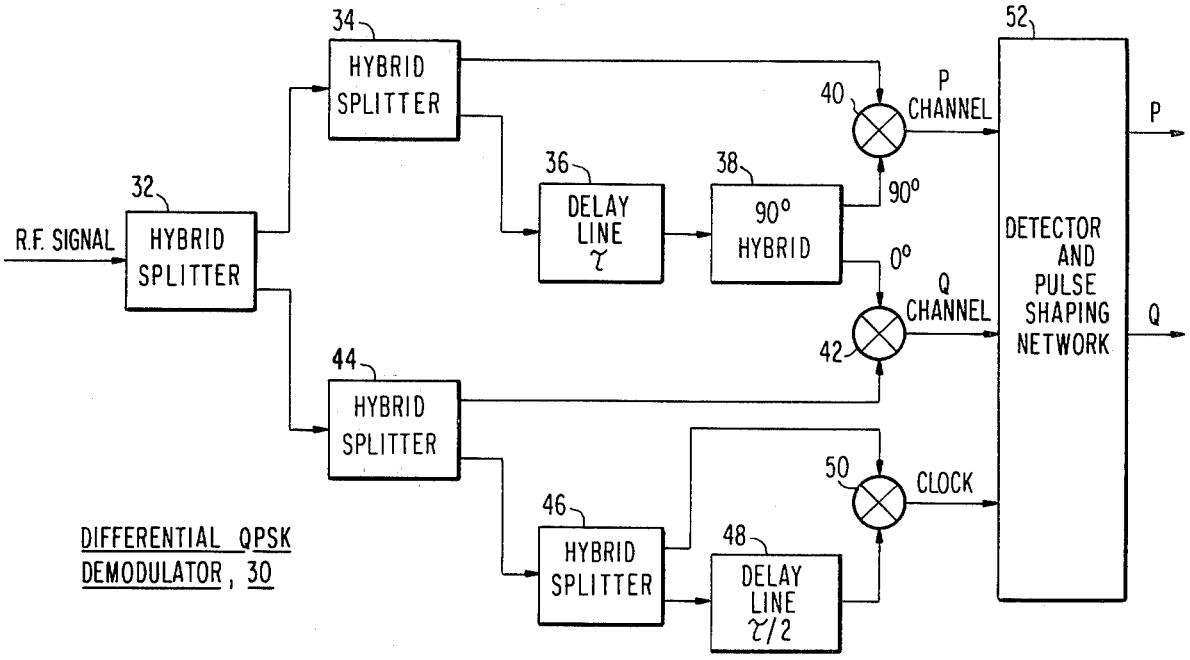
FIG. 3 is a block diagram of a differentially coherent quaternary phase shift keyed demodulator in which the present invention is used to advantage.

Referring next to FIG. 3, there is shown a block diagram of a differential QPSK demodulator such as would be used in a communication satellite relay application in which the present invention may be used to particular advantage. The incoming RF signal is divided by hybrid splitter 32 into two equal phase components. Hybrid splitters 34 and 44 again divide the signal, each producing two outputs of equal phase. One of the outputs of hybrid splitter 34 is coupled to one input of P channel mixer 40. The other output from hybrid splitter 34 is coupled through delay line 36 to 90° hybrid circuit 38. The 90° output of 90° hybrid 38 is coupled to the second input of P channel mixer 40.

Delay line 36, which is a delay line constructed in accordance with the teachings of the present invention, has a delay time of one bit-time period. A phase stability of better than ±5% must be maintained over the entire temperature range of operation to render acceptable the bit error rate performance of the demodulator circuit.

The present bit output represented by the upper output line from hybrid splitter 34 is thus detected against the previous bit (produced at the output of delay line 36) shifted by 90°. A signal representing the previous bit unshifted in phase is produced at the lower output of 90° hybrid 38 and coupled to one input of Q channel mixer 42. The present bit signal is coupled to the other input of Q channel mixer 42 as produced at the output of hybrid splitter 44. The output of Q channel mixer 42 thus represents the detection of the present bit against the previous bit unshifted in phase.

The outputs of both P and Q channel mixer 40 and 42, respectively, are coupled through detector and pulse-shaping network 52 forming the final P and Q outputs. A clock signal for operating detector and pulse-shaping network 52 is formed by splitting the lower output signal from hybrid splitter 44 into two equal phase components by hybrid splitter 46, delaying one of the outputs of hybrid splitter 46 by a period of $\tau/2$ (equal to $\frac{1}{2}$ bit-time period) and combining the two signals with mixer 50.

This completes the description of the preferred embodiments of the invention. Although preferred embodiments have been described, it is believed that numerous modifications and alterations thereto would be apparent to one having ordinary skill in the art without departing from the spirit and scope of the invention.

What is claimed is:

1. A microwave integrated circuit delay line device comprising in combination:
- a substrate of dielectric material;
- a plurality of conductive strips disposed on a surface of said substrate to form a delay line; and
- means for maintaining the delay time for signals propagating along said delay line substantially constant over a predetermined range of temperature for at least a predetermined frequency.

2. The combination of claim 1 wherein said delay time maintaining means comprises means for varying the electromagnetic field pattern adjacent said conductive strips in accordance with ambient temperature.

3. The combination of claim 2 wherein said electromagnetic field pattern varying means comprises:
- one or more conductors disposed adjacent said substrate; and
- means for varying the position of said one or more conductors relative to said substrate in accordance with ambient temperature.

4. A temperature-compensated microwave integrated circuit device comprising in combination:
- a substrate of dielectric material;
- a plurality of conductive strips disposed on a surface of said substrate;
- a conductive plate disposed adjacent said substrate; and
- means for varying the position of said conductive plate with respect to said substrate in accordance with changes in temperature to maintain predetermined parameters for signals upon said conductive strips at a substantially constant value over a predetermined range of temperature.

5. The combination of claim 4 wherein said conductive strips are disposed in a pattern to provide a delay line.

6. The combination of claim 5 wherein said predetermined parameters comprise the even-mode dielectric constant.

7. A temperature-compensated microwave integrated circuit device comprising in combination:
- a substrate of dielectric material;
- a plurality of conductive strips disposed on a surface of said substrate, said plurality of conductive strips including an input conductor and output conductor;
- a first conductive plate disposed adjacent said substrate; and means for varying the position of said first conductive plate with respect to said substrate in accordance with changes in temperature, the movement of said first conductive plate being such that the phase of signals at said output conductor is independent of temperature over a predetermined temperature range for signals of a predetermined frequency.

8. The combination of claim 7 further comprising means for providing mechanical support for said substrate, and wherein said position varying means comprises a body of material coupling said first conductive plate to said mechanical support providing means, said body having dimensions and a coefficient of expansion such that the phase of signals at said output conductor is substantially independent of temperature over a predetermined temperature range for signals of a predetermined frequency.

9. The combination of claim 8 wherein said mechanical support providing means comprises a second conductive plate disposed parallel to said substrate on the side of said substrate opposite said first conductive plate.

10. The combination of claim 9 wherein said mechanical support providing means comprises at least one conductive wall, said conductive wall being coupled to said second conductive plate and said body of material coupling said first conductive plate to said mechanical supporting providing means.

11. The combination of claim 10 wherein said first and second conductive plates and said at least one conductive wall form a closed cavity for signals of said predetermined frequency.

12. The combination of claim 7 wherein said conductive strips are disposed to form a delay line.

13. A temperature-compensated microwave integrated circuit device comprising in combination:

a substrate of dielectric material;

a plurality of conductive strips disposed on said layer including an input and output conductor;

a first conductive plate disposed adjacent said substrate, there being a gap between said substrate and said first conductive plate;

a conductive support frame, said frame comprising a second conductive plate and four conductive walls coupled to said conductive plate, said substrate being disposed within said frame between and parallel to said first and second conductive plates;

a cover connected to said conductive walls and closing said frame; and a temperature compensating layer coupling said first conductive plate to said cover, the thickness and coefficient of expansion of said temperature compensating layer being such that the phase of signals at said output conductor is substantially independent of temperature for signals of a predetermined frequency.

14. The combination of claim 13 wherein said temperature compensating layer comprises a silicon resin.

15. The combination of claim 14 wherein said conductive strips are disposed to form a delay line.

16. The combination of claim 13 wherein said substrate of dielectric material comprises fused silica.

17. The combination of claim 13 wherein said first and second conductive plates are substantially rectangular in shape.

* * * * *

UNITED STATES PATENT AND TRADEMARK OFFICE

CERTIFICATE OF CORRECTION

PATENT NO. : 4,218,664

DATED : August 19, 1980

INVENTOR(S) : Assal et al

It is certified that error appears in the above-identified patent and that said Letters Patent are hereby corrected as shown below:

IN THE SPECIFICATION:

Column 3, line 6, delete "strip" and insert -- strips --.

Column 5, lines 10 and 11, "and thickness" should be included in the parenthesis.

IN THE CLAIMS:

Claim 10, Column 7, line 30, delete "supporting" and insert -- support --.

Signed and Sealed this

*Thirtieth* Day of *December 1980*

[SEAL]

*Attest:*

SIDNEY A. DIAMOND

*Attesting Officer*

*Commissioner of Patents and Trademarks*